US005235962A

United States Patent [19]

Doty et al.

[11] Patent Number: 5,235,962

[45] Date of Patent: Aug. 17, 1993

[54] FORCED CIRCULATION OVEN DOOR

[75] Inventors: Roger F. Doty, Connersville, Ind.; Edwin H. Strain, Tucson, Ariz.

[73] Assignee: Maytag Corporation, Newton, Iowa

[21] Appl. No.: 941,548

[22] Filed: Sep. 8, 1992

[51] Int. Cl.[5] ..... A21B 1/00

[52] U.S. Cl. ..... 126/21 A; 126/198; 219/400; 34/233

[58] Field of Search ..... 126/21 R, 21 A, 273 R, 126/273 A, 275 R, 190, 198, 200, 193, 19 R, 19 M, 15 A, 15 R; 432/206; 219/400, 368, 407; 34/233, 201, 202, 230, 219, 223; 134/186

[56] References Cited

U.S. PATENT DOCUMENTS

| | | | |
|---|---|---|---|
| Re. 26,063 | 1/1963 | Keating | 126/21 A |
| 2,898,691 | 8/1959 | Moseman et al. | 34/233 |
| 3,068,877 | 12/1962 | Jacobs | 134/186 |
| 3,135,859 | 6/1964 | Mitter | 219/400 |
| 3,414,708 | 12/1968 | Maier | 219/400 |
| 3,908,681 | 9/1975 | Schimke et al. | 134/94 |
| 4,010,341 | 3/1977 | Ishammar | 126/21 A |
| 4,484,063 | 11/1984 | Whittenburg et al. | 219/400 |
| 4,687,908 | 8/1987 | Thorne | 219/400 |
| 4,813,398 | 3/1989 | Savage | 126/21 |
| 4,829,158 | 5/1989 | Burnham | 219/400 |

FOREIGN PATENT DOCUMENTS

| | | | |
|---|---|---|---|
| 2115222 | 5/1973 | Fed. Rep. of Germany | 34/233 |

*Primary Examiner*—James C. Yeung

*Attorney, Agent, or Firm*—Willian Brinks Olds Hofer Gilson & Lione

[57] ABSTRACT

An oven door that provides forced circulation of the heated air within the interior of an oven chamber is presented. The oven door includes an outside door wall, an inside door wall, and a plurality of interior walls disposed between the outside door wall and the inside door wall that form an air-directing plenum carried within the oven door. The inside door wall has a plurality of openings providing air circulation between the air-directing plenum and the interior of the oven chamber. A motorized fan assembly, located within the oven door, forcibly circulates air through the plurality of openings in the inside door wall, the air-directing plenum and throughout the interior of the oven chamber.

14 Claims, 4 Drawing Sheets

FORCED CIRCULATION OVEN DOOR

FIELD OF THE INVENTION

This invention relates to cooking ovens and, more particularly, to a door for a domestic cooking oven having a forced air circulation system disposed within the door for more rapidly and uniformly cooking food products.

BACKGROUND OF THE INVENTION

Ovens for domestic use today employ a wide variety of cooking methods. The most common types of ovens are the conventional electric and gas ovens which cook the food by radiant heat.

In cooking with an oven, a principal objective is frequently (for example, when baking) to achieve a substantially uniform temperature throughout the interior of the oven chamber as the quality and "doneness" of the cooked food product is closely related to the uniformity of interior oven temperature. A problem with conventional ovens is often the nonuniformity of the temperature within the oven chamber. Conventional ovens typically have a natural hot air flow pattern dictated by the interior geometry of the oven that results in uneven heating within the oven chamber and food that is not cooked uniformly. Thus, it is important to achieve substantially uniform heating of the oven cooking chamber.

Convection ovens employ a blower means in the oven chamber to circulate air at elevated velocities within the oven chamber to improve heat distribution and the effectiveness of the heating elements and to reduce the cooking time. In many cooking situations, there is often a layer of air adjacent the surface of the food being cooked and/or the cooking utensils which provides, in effect, a thermal barrier that retards the cooking process. The increased circulation of heated air that may result from forced air flow may eliminate this barrier, thereby facilitating the transfer of heat to the food and resulting in faster cooking times. In addition, the circulation of heated air within the oven chamber generally improves the temperature uniformity within the oven and contributes to more even cooking.

Prior attempts at providing an effective convection oven are numerous. U.S. Pat. No. Re. 26,063 (originally U.S. Pat. No. 3,074,393) discloses an oven provided with a blower-and-motor assembly mounted adjacent the rear wall in the interior of the oven chamber. A baffle plate positioned in front of the blower is formed with a central aperture which permits air to flow axially into the blower impeller which, in turn, expels the air radially outwardly, in a turbulent manner, toward the sides, top and bottom walls of the oven chamber as directed by the baffle plate.

U.S. Pat. No. 4,010,341 discloses a well-type oven equipped with a fan, a heater and a plurality of circulation passages. The oven of the '341 patent comprises a well which is positionable within a counter or similar support, is open at the top, and has a removable insert disposed therein defining, together with the well, the circulation passages. The fan and the heater are positioned in the lower side of a lid that is removably fitted over the well to define a top closure for the oven.

U.S. Pat. No. 4,687,908 discloses a portable, self-contained convection blower for use with conventional ovens. The portable electric blower may be placed on the floor of the oven to circulate heated air throughout the oven chamber.

U.S. Pat. No. 4,484,063 describes a convection oven having an air-distribution chamber disposed above the main cooking compartment. The oven of the '063 patent includes a centrifugal fan disposed behind a diffuser panel which is provided with discharge openings of non-uniform size and asymmetrical patterns. The discharge openings are so arranged to take advantage of the oven geometry in an attempt to achieve uniform heating of the cooking compartment with a closed-air circulation system.

U.S. Pat. No. 4,813,398 discloses a gas-fired convection oven comprising a blower fan mounted on the rear wall of the interior of the cooking chamber. A vertical shroud is mounted adjacent the fan opposite of the rear wall to form a narrow heat-exchanging chamber within the oven chamber. The vertical shroud is formed with a partially baffled, centrally disposed air opening to ensure that each of the two legs of a heat exchanger receive approximately equal portions of combustion air and gas such that uniform heating of the heat exchanger is possible in an attempt to achieve better heat distribution throughout the interior of the cooking chamber.

U.S. Pat. No. 4,829,158 discloses a portable electric convection oven having a blower means provided in a side wall of the oven housing. The interior of the oven is organized with a central food receiving area spaced between upper and lower air-distribution plenums. Separating the plenums and the central food receiving area are two removable air-distribution plates that are provided with formed perforations therein that define nozzles to direct the heated air against the food products.

Attempts have also been made to position a fan means within the door of a dishwasher for circulating air within the washing chamber during the drying cycle. Exemplary of such attempts are U.S. Pat. Nos. 3,068,877 and 3,908,681.

U.S. Pat. No. 3,068,877 describes a dishwasher door having a first conduit located within the door in communication with the dishwasher chamber and a second conduit in communication with the atmosphere and in heat exchange relationship with the first conduit. The door of the '877 dishwasher further includes a blower system driving a first impeller disposed in the first conduit for recirculating vapor from the dishwashing chamber and a second impeller disposed in the second conduit for circulating cooling air from the atmosphere.

U.S. Pat. No. 3,908,681 describes a forced-air circulation system for a dishwasher, incorporating a fan-and-motor assembly mounted within the dishwasher door for circulating air downwardly through the wash chamber during the drying cycle.

As noted above, forced convection ovens generally offer an advantage over conventional ovens in their reduction of cooking times by more uniform heat transfer to the food product. With prior ovens, forced circulation systems were formed in the walls of the oven chambers where the blower and motor were relatively inaccessible and their location exposed them to the high temperatures of the oven chamber and required relatively expensive motors and insulating structures designed for high temperature operation. Furthermore, location of the forced circulation system within the oven reduced the interior capacity of the oven chamber.

SUMMARY OF THE INVENTION

This invention comprises a door for a forced convection electric or gas oven that provides forced circulation of the heated air within the interior of the oven chamber. The oven door of this invention generally comprises an outside door wall, an inside door wall, a plurality of interior walls disposed between the outside door wall and the inside door wall that form an air-directing plenum carried within the oven door. The inside door wall has a plurality of openings between the air-directing plenum and the interior of the oven chamber, and a motorized fan assembly located within the door circulates air through the plurality of openings in the inside door wall, the air-directing plenum and throughout the interior of the oven chamber.

The oven door provided by this invention includes a window for providing visual access to the interior of the oven, and the interior walls of the oven door preferably form a U-shaped air-directing plenum with a central portion below the window and a pair of outer portions extending along the outer edges of the inside door wall on both sides of the window.

The plurality of openings provided in the inside door wall of the oven door are preferably located in a plurality of groups of openings. A first group of openings is located to communicate with the central portion of the air-directing plenum and the central portion of the oven chamber. A second group of openings is preferably located in each of the outer portions of the air-directing plenum to communicate with the outer portions of the oven chamber. The inside door wall can further carry a removable cover for the air-directing plenum having the plurality of openings formed therein and further carrying a plurality of air-directing vanes positioned adjacent to the second group of openings formed in the outer portions of the air-directing plenum.

The fan assembly provided by this invention is preferably located adjacent to the first group of openings and is adapted to draw air from the central portion of the oven chamber interior into the air-directing plenum through the first group of openings and expel air into the outer portions of the oven chamber interior through the second group of openings located in the outer portions of the air-directing plenum.

A first interior wall of the plurality of interior walls of the oven door is preferably disposed between the fan and the fan motor to define the air-directing plenum on the inward or oven side of the first interior wall and a chamber on the outward or room side of the first interior wall. The motor carries an additional fan disposed within the chamber for circulating air within the chamber to cool the motor during operation. A second interior wall of the plurality of interior walls can be positioned to provide thermal insulation between the air-directing plenum and the outside door wall of the oven door.

The positioning of the forced circulation system and motorized fan assembly within the oven door does not interfere with oven chamber size and provides a modular design. Oven chambers can be designed and built to provide both conventional and forced circulation systems, and oven doors provided by this invention can be added or affixed to the oven after the construction of the oven unit is completed. The space adjacent the rear wall of the oven chamber, which has traditionally been reserved for the convection motor assembly in prior systems, is available under the present invention for other features, including rear venting or deeper oven capacity.

The foregoing and other features of the invention will be more particularly described in connection with the preferred embodiment of the invention and with reference to the accompanying drawings.

DESCRIPTION OF THE PREFERRED EMBODIMENT

This invention relates to an oven door including a forced-air circulation system for more rapidly and uniformly cooking food products in an oven.

Figure 1:
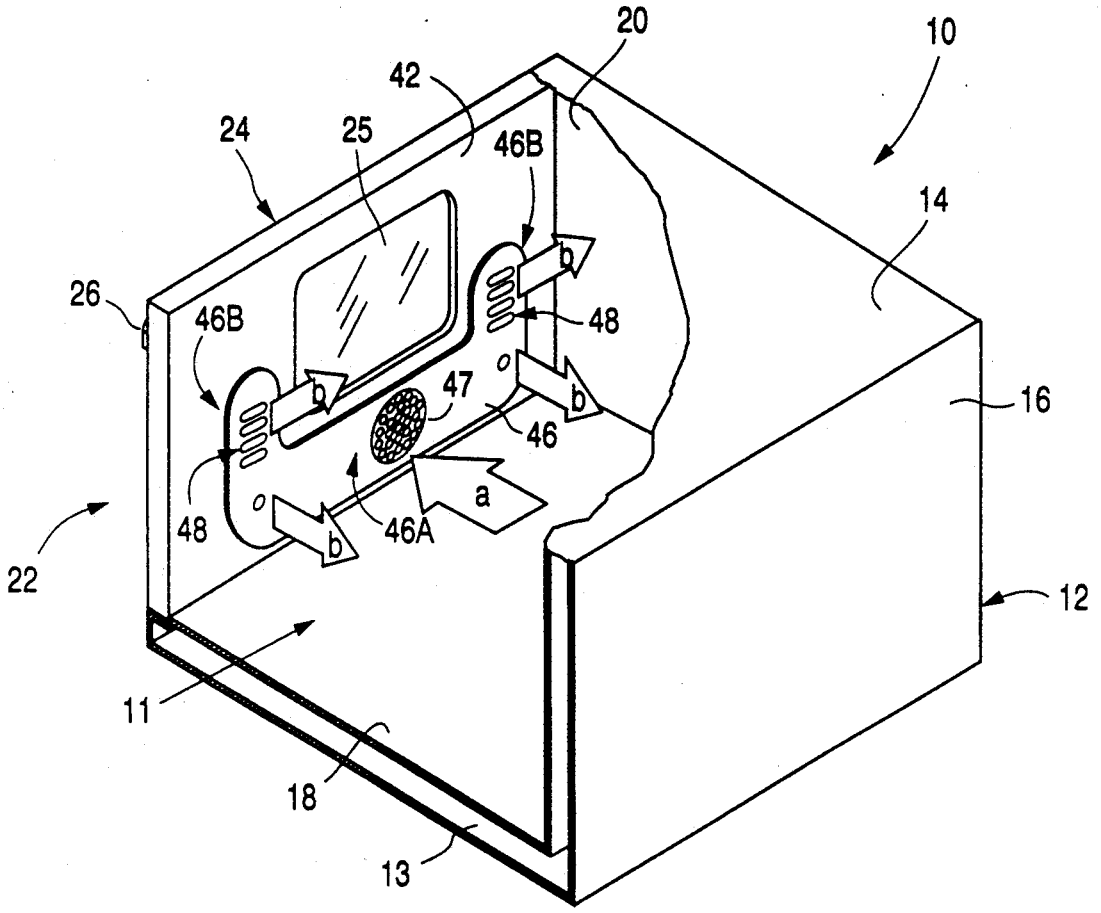
FIG. 1 is a perspective view of an oven having a forced circulation system provided by this invention, the top and side walls of the oven being partially broken away for purposes of illustrating the interior of the oven door of this invention.
Figure 2:
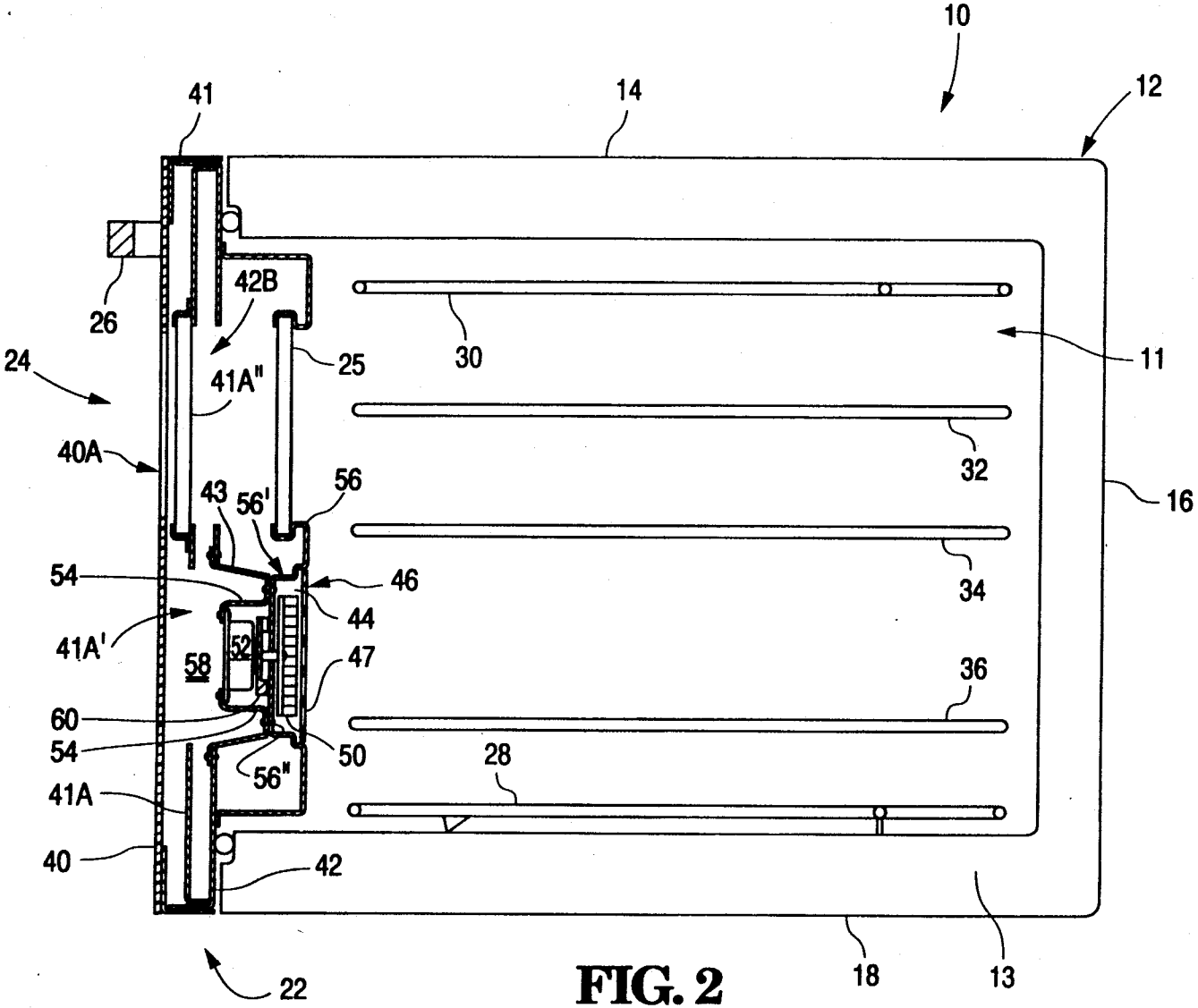
FIG. 2 is a side cross-section of an oven having the forced circulation system of FIG. 1.

As shown in FIGS. 1 and 2, oven 10 preferably comprises a box-like structure 12 having a top wall 14, a rear wall 16, opposing side walls 20 (for purposes of illustration, the foreground side wall in FIG. 1 has been omitted) and a front wall 22, all of which collectively form an interior heating or cooking chamber 11. Front wall 22 is formed by a hinged oven door 24 adapted to be opened by a handle 26 to provide access to the interior heating chamber 11. Oven 10 can further include one or more heating elements (not shown in FIG. 1) operatively supported within the heating chamber 11 for heating and cooking food products. Where the oven is an electric oven, such heating elements can include, as shown for example in FIG. 2, a baking heating element 28 located adjacent to the bottom wall 18 and a broiling heating element 30 located adjacent to the top wall 14. While not shown, it is understood that oven 10 can be connected to an energy source, such as a source of electrical energy, which can provide energy to the heating elements such as elements 28, 30. In a gas oven of the invention, gas burners within the oven chamber will be connected with a source of gas. The walls of the heating chamber 11 can also support a plurality of racks for supporting the food products received within the oven, including an upper rack 32, a middle rack 34 and a lower rack 36. The walls forming the box-like structure 12 can have interior spaces 13 with insulation to retain the high temperatures within the heating chamber 11 and to reduce the temperatures of the outer walls at the exterior of oven 10.

Oven door 24, shown in an exploded perspective view in FIG. 3 and in a cross-section view in FIGS. 2 and 4, preferably comprises an outside door wall 40 and an inside door wall 42 and a plurality of interior door walls forming an air-directing plenum 44 inside of door 24 as set forth further below. Inside door wall 42 carries a tub-like door plug member 56, preferably constructed of porcelain-coated steel, having an opening 56A in its upper central region. Door plug member 56 is drawn inwardly in its lower portion to form a recession 56' (when viewed from cover plate 46 of FIG. 3). Recession 56' is located below the opening 56A and extends in a U-shape upwardly at each side of the opening 56A. Cover plate 46 is positioned to cover the recession 56' on the inward or oven side of door plug member 56 and, in cooperation with door plug member 56, defines an air-directing plenum 44 therebetween, as shown in FIGS. 2 and 4. Cover plate 46 is formed with a plurality of openings 47, 48 formed therein for allowing air circulation between the air-directing plenum 44 and heating chamber 11. An impeller or fan 50 is located in the air-directing plenum 44 to be driven by a motor 52, supported by a pair of Z-brackets 54 outside of the air-directing plenum 44. Motor 52 is coupled with the electrical energy source located outside of the oven door 24 which operates the oven 10. Upon operation of motor 52, air is circulated through the plurality of openings 47, 48 provided in cover plate 46 between the air-directing plenum 44 within door 24 indicated in FIG. 1.

Figure 3:
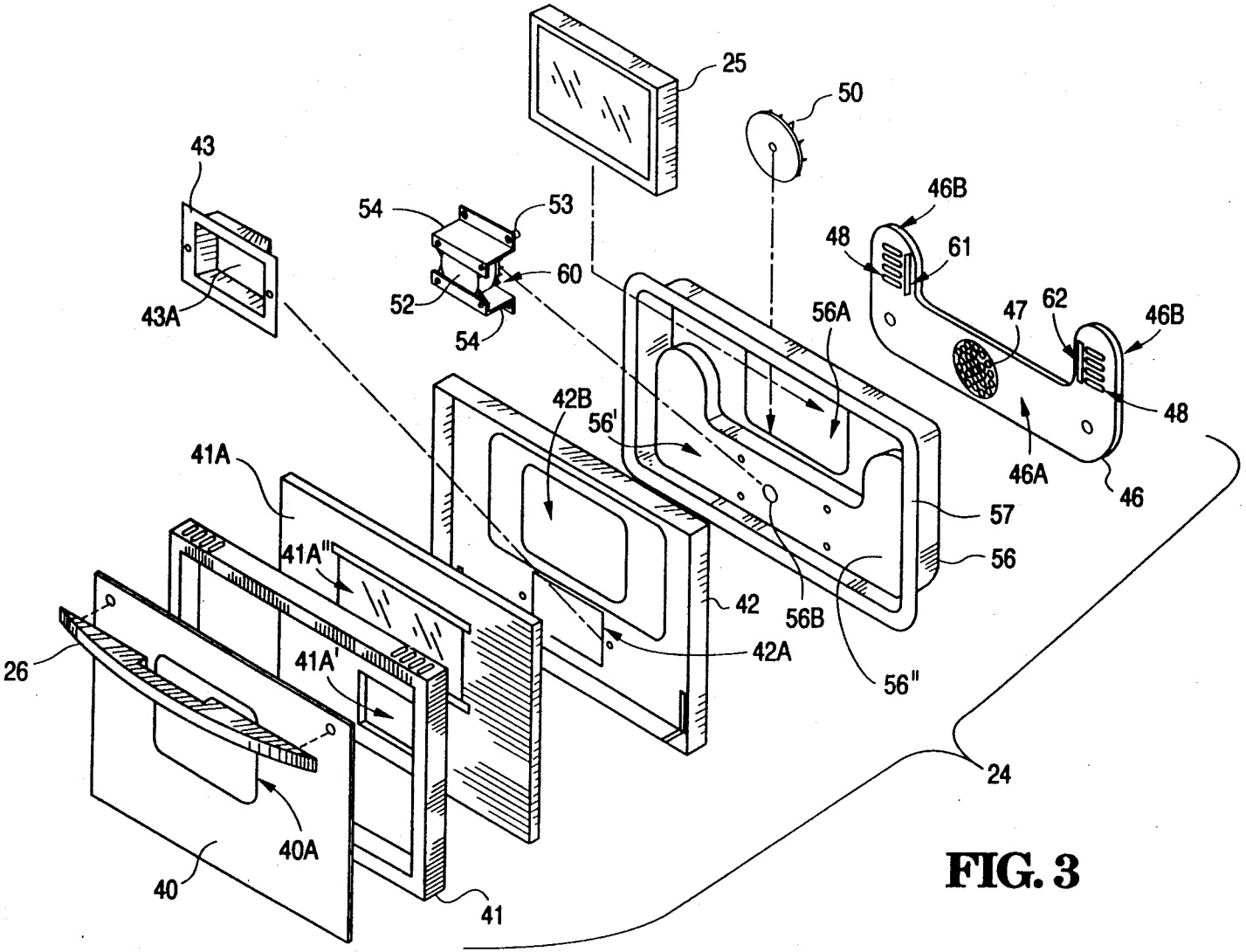
FIG. 3 is an exploded perspective view of the oven door assembly of FIG. 1.
Figure 4:
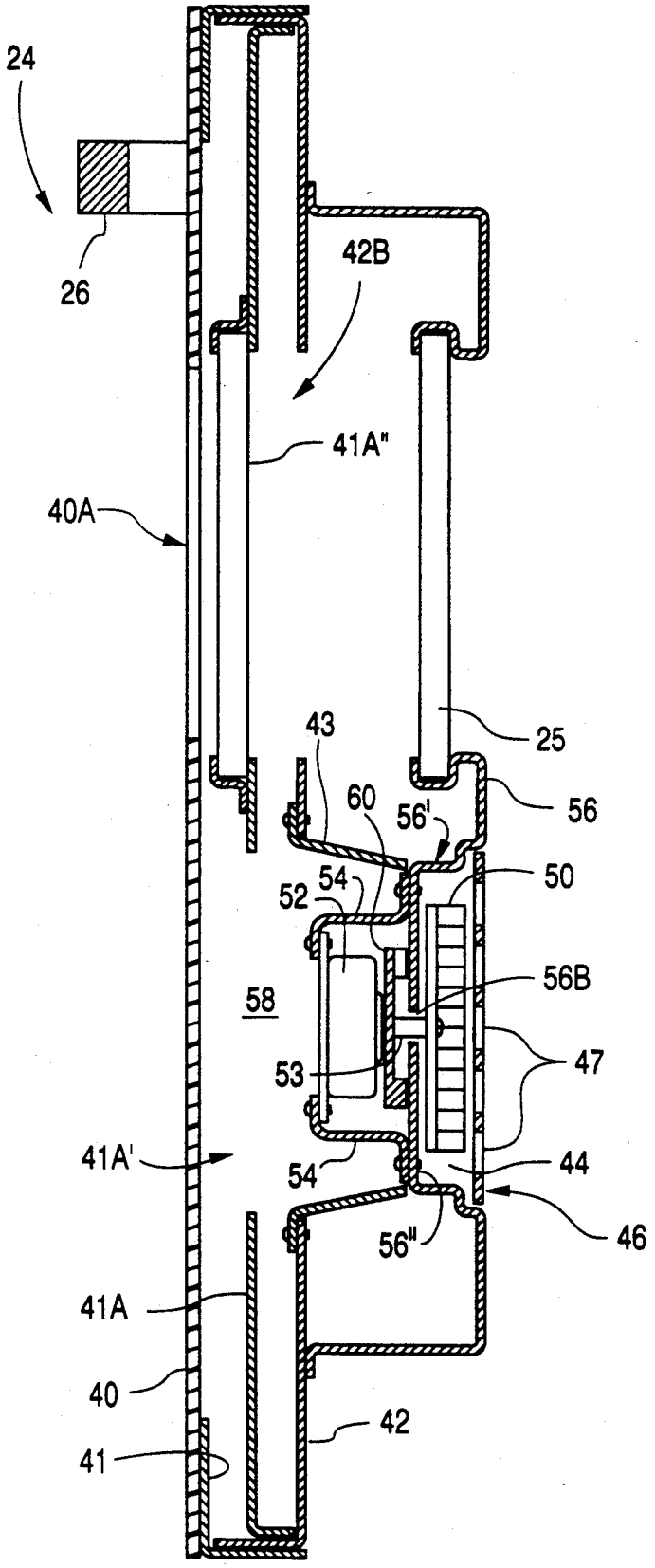
FIG. 4 is an enlarged cross-section through the oven door provided by this invention to more clearly show its interior arrangement.

As best shown in FIGS. 1 and 3, the plurality of interior door walls provided by this invention form a U-shaped air-directing plenum 44 formed by recession 56' with a central portion below the opening 56A and outer leg portions extending upwardly along the outer edges of the door plug member 56 on both sides of the opening 56A. While not individually numbered in the drawings, the central and outer leg portions of the recession 56' forming air-directing plenum 44 generally correspond with the central portion 46A and outer leg portions 46B of cover plate 46 shown in FIG. 3. The plurality of openings provided in the cover plate 46 are arranged, preferably, in a first group of openings 47 located in the central portion 46A of cover plate 46 to provide air communication between the central region of the heating chamber 11 and the central portion of air-directing plenum 44, and a second group of openings 48 located in each of the outer leg portions 46B of cover plate 46 to provide air communication between the outer potions of the heating chamber 11 and the outer leg portions of air-directing plenum 44. Fan 50 can be located adjacent to the first group of openings 47 to draw air through the first group of openings 47 from the central region of the interior of heating chamber 11 into the air-directing plenum 44, as shown by larger single reference arrow "a" in FIG. 1, and to expel air into the outer portions of the interior of heating chamber 11 through the second group of openings 48, as shown by smaller multiple reference arrows "b" in FIG. 1. Air-directing vanes 61, 62 can be disposed within plenum 44 adjacent to the second group of openings 48 for directing the air within the air-directing plenum 44 to provide desirable distribution within the heating chamber 11 from the second group of openings 48. While the drawings depict the openings 47 of the first group to be circular and the second group of openings 48 at each leg portion 46B as comprising a vertical column of horizontal ovals positioned above a circular orifice, the specific size, number and spacing of the openings of either or both groups can be varied.

A first interior wall, defined by door plug member 56, defines an interior partition means 56" at the bottom of recession 56' which lies between the fan 50 and the motor 52, as shown in FIGS. 2 and 4, and forms an interior chamber 58 between the outside door wall 40 and door plug member 56. Motor 52 is located within chamber 58 and its drive shaft 53 extends through a central aperture 56B provided in the interior partition means 56" at the bottom of recession 56' of door plug member 56 and carries fan 50 at its distal end. Preferably, motor 52 also drives a second impeller or fan 60 secured to drive shaft 53 and located within chamber 58 on the outer side of interior partition means 56" of door plug member 56 for circulating air within chamber 58 to provide cooling for the motor 52 during operation. As shown in FIG. 4, a second interior wall defined by a baffle member 41A can be positioned between the inside door wall 42 and the outside door wall 40 of the oven door 24 to provide thermal isolation.

One preferred structure of oven door 24 will now be described in further detail with reference to FIG. 3, which presents an exploded perspective view of one oven door 24 and forced circulation system provided by this invention. Outside door wall 40 is supported on a frame member 41, which may be a painted steel frame, providing an outer wall assembly. Outside door wall 40 may be constructed of steel, plastic, glass, or the like, and is preferably constructed of darkened, heat-resistant glass, such as PYREX, with a clear portion 40A provided therein for visibility. Outside door wall 40 may be affixed to frame member 41 through conventional means, including adhesives, welding or mechanical fasteners, such as screws or nuts and bolts, for example. Attached to the outward side of wall 40 adjacent its top is a handle 26 which may be used to open oven door 24 to provide access to the interior heating chamber 11.

An inner door assembly is provided by inside door wall 42, preferably defined by a door liner constructed of porcelain-coated steel having a first opening 42A in its lower central region and a second opening 42B in its upper central region. Inside door wall 42 carries door plug member 56. A truncated-pyramidal "scoop" member 43 is positioned within opening 42A and fastened to inside door wall 42 by conventional means. Baffle member 41A, which is preferably constructed of steel and includes an opening 41A' in its lower central region and carries a thermal window 41A" in its upper central region, fits within inside door wall 42 which, in turn, fits within frame member 41. Opening 42A communicates with opening 41A' provided in baffle member 41A. The mounting assembly for motor 52, defined by Z-brackets 54, is conventionally affixed to the outward side of recession 56' of door plug member 56 at mounting holes corresponding with mounting holes provided in the Z-brackets 54 so that the drive shaft 53 of motor 52 extends through central aperture 56B as best shown in FIG. 4. A window 25 is secured within opening 56A in door plug member 56. (A visual access path is thereby defined by clear portion 40A of outside door wall 40, thermal window 41A" of baffle member 41A, opening 42B of inside door wall 42 and window 25.) The door plug member 56 is secured to the inward side of the door liner 42 so that the motor 52 and its mounting Z-brackets 54 are received through and fit within the opening 43A provided in scoop 43. The inward edge of scoop 43 rests adjacent to the outward side of the recession 56' of door plug member 56 (best seen in FIG. 4) and thereby cooperates to define interior cooling chamber 58. Door plug member 56 may be secured to door liner 42 along its perimeter flange 57. Cover plate 46 is removably fastened, for example, by machine screws, to the inward side of door plug member 56 over the recession 56' to define therebetween the air-directing plenum 44.

As noted above, the oven door 24 of this invention draws air through the first group of openings 47 provided in the central portion 46A of cover 46 into air-directing plenum 44 and expels air out into the heating chamber 11 through the second group of openings 48 provided in the outer leg portions 46B of cover plate 46. Thus, this invention provides an oven door providing forced circulation of the air within an oven interior comprising an outside door wall and an inside door wall forming a door for the oven, and a plurality of interior door walls disposed therebetween to form an air-directing plenum within the oven door, and a motorized fan assembly located within the oven door so that operation of the motor forcibly circulates air through a plurality of openings provided in the inside door wall, the air-directing plenum and the interior of the oven heating chamber.

The oven door system that has been described above is a preferred embodiment provided by this invention and modifications and variations may be made to this embodiment without departing from the scope of the invention as defined in the following claims and the prior art and such modifications and variations are considered to be within the purview and scope of the claims.

We claim:

1. An oven door providing forced air circulation within an oven chamber interior, comprising:

an outside door wall, an inside door wall and a plurality of interior door walls disposed between said outside door wall and said inside door wall, said plurality of interior door walls forming an air-directing plenum disposed within said oven door, said inside door wall including a plurality of openings providing air flow communication between said air-directing plenum and said oven chamber interior; and a fan located in said air-directing plenum and a motor located inside of said oven door for driving said fan, said motor being adapted for connection with a power source located outside of said oven door whereby, upon operation of said motor, air is circulated through the plurality of openings in said inside door wall, said air-directing plenum and said oven chamber interior, said plurality of interior door walls further forming a closed interior chamber within said oven door, said motor being arranged within said interior chamber and driving a second fan disposed within said interior chamber for circulating air therewithin to provide cooling for said motor.

2. The oven door of claim 1 wherein a first interior wall of said plurality of interior door walls lies between said fan and said motor and forms a chamber adjacent to said outside door wall, and wherein said motor drives a second fan disposed in said chamber for circulating air within said chamber to cool said motor during operation.

3. The oven door of claim 2 wherein a second interior wall of said plurality of interior walls of said oven door is positioned between said air-directing plenum and said outside door wall of said oven door.

4. In an oven door providing access to the interior of an oven and including an outside wall and an inside wall, the improvement comprising:

a plurality of interior walls disposed between said outside wall and said inside wall forming an air-directing plenum within said oven door adjacent to said inside wall, said plurality of interior walls further forming a closed interior chamber within said oven door adjacent said air-directing plenum, said inside wall including a plurality of openings providing air circulation between said oven interior and said air-directing plenum;

a first impeller carried within said air-directing plenum and driven by a motor located outside of the air-directing plenum within the closed interior chamber of said oven door, said impeller and motor being operable to circulate air through the plurality of openings and within said oven interior at elevated velocities; and a second impeller carried within said closed interior chamber and also being driven by said motor for circulating air within the closed interior chamber to provide cooling for said motor.

5. An oven comprising:

a box-like structure forming a heating chamber, said box-like structure having a top wall, a rear wall, a bottom wall, opposing side walls and a front wall having an opening formed therein for accessing the heating chamber of said oven;

at least one heating unit operatively carried within said heating chamber for heating oven contents;

a source for providing heating energy to said heating unit; and a door for closing the opening in the front wall of said oven, said door being adapted to be opened, said door including a front panel and a rear panel that is substantially parallel to and spaced from said front panel, thereby forming a door interior, a thermal wall disposed within the interior of said oven door for isolating the heating chamber of said oven from the atmosphere, and a blower system arranged within said door interior, said rear panel including a plurality of openings formed therein and said blower system being adapted to forcibly circulate air through said door interior, said plurality of openings, and said heating chamber of said oven.

6. The oven as in claim 5 wherein said door includes an interior partition defining a chamber within said door interior on the outward side of said interior partition and a plenum within said door interior on the inward side of said interior partition, and wherein said blower system includes a motor located within said chamber, a first fan located in said plenum of said door interior for circulating air in said heating chamber of said oven, and a second fan located in said chamber for circulating air within said chamber to cool said motor during operation, said first and second fans being supported on a single drive shaft coupled to said motor, said drive shaft extending through an opening formed in said interior partition into said plenum.

7. The oven as in claim 6 wherein said plenum is in air flow communication with said heating chamber of said oven through inlet means and outlet means, said first fan being disposed within said plenum adjacent to said inlet means and being adapted to draw air from said heating chamber into said plenum through said inlet means and to expel air out of said plenum into said heating chamber through said outlet means.

8. A forced circulation door for an oven having an interior heating chamber, comprising:

an outer wall assembly including a frame member, a front panel supported upon said frame member, and a handle for opening said door;

an inner wall assembly including a door liner, a tub-like plug member having a U-shaped recessed portion formed therein and being secured to the inward side of said door liner, and a cover adapted to be positioned over said recessed portion of said plug member thereby defining a plenum therebetween, said cover including a first group of inlet openings formed in a central portion of said cover and a second group of outlet openings formed in each of the outer portions of said cover, a first impeller located within said plenum adjacent to said first group of inlet openings of said cover;

a second impeller located outside of said plenum between said plug member and said outer wall assembly; and an electric motor located between said plug member and said outer wall assembly, said motor being adapted to drive said first impeller positioned within said plenum for circulating air between said plenum and said interior heating chamber of said oven, and to drive said second impeller for circulating air within said door for cooling said motor during operation, said first impeller being adapted to draw air from said interior heating chamber into said plenum through said first group of inlet openings and to expel air out of said plenum into said interior heating chamber of said oven through said second group of outlet openings.

9. An oven door providing forced air circulation within an oven chamber interior, comprising:

an outside door wall, an inside door wall and a plurality of interior door walls disposed between said outside door wall and said inside door wall, said plurality of interior door walls forming an air-directing plenum disposed within said oven door, said inside door wall including a plurality of openings providing air flow communication between said air-directing plenum and said oven chamber interior;

a fan located in said air-directing plenum and a motor located inside of said oven door for driving said fan, said motor being adapted for connection with a power source located outside of said oven door whereby, upon operation of said motor, air is circulated through the plurality of openings in said inside door wall, said air-directing plenum and said oven chamber interior; and window means, said interior door walls forming a U-shaped air-directing plenum with a central portion below said window means and a pair of outer leg portions extending along the outer edges of said inside door wall on both sides of said window means.

10. The oven door of claim 9 wherein the plurality of openings in said inside door wall are located in a plurality of groups of openings, a first group of openings being located to provide air flow communication between a central portion of said air-directing plenum and a central portion of said oven chamber interior, and a second group of openings being located in each of said outer leg portions to provide air flow communication between outer portions of said oven chamber interior and said outer leg portions of said air-directing plenum, said fan being located in said air-directing plenum adjacent to said first group of openings and adapted to draw air through said first group of openings from the central portion of said oven chamber interior into said air-directing plenum, and to expel air into the outer portions of said oven chamber interior through said second group of openings.

11. The oven door of claim 10 wherein said inside door wall carries a removable cover for said air-directing plenum, said removable cover including the plurality of openings.

12. An oven door providing forced air circulation within an oven chamber interior, comprising:

an outside door wall, an inside door wall and a plurality of interior door walls disposed between said outside door wall and said inside door wall, said plurality of interior door walls forming an air-directing plenum disposed within said oven door, said inside door wall including a plurality of openings providing air flow communication between said air-directing plenum and said oven chamber interior; and a fan located in said air-directing plenum and a motor located inside of said oven door for driving said fan, said motor being adapted for connection with a power source located outside of said oven door whereby, upon operation of said motor, air is circulated through the plurality of openings in said inside door wall, said air-directing plenum and said oven chamber interior, said plurality of openings in said inside door wall being located in a plurality of groups of openings, a first group of openings being located in air flow communication with a central portion of said oven chamber interior and a second group of openings being located in air flow communication with outer portions of said oven chamber interior, said fan being adapted to draw air through said first group of openings from the central portion of said oven chamber interior into the air-directing plenum, and to expel air into the outer portions of said oven chamber interior through said second group of openings.

13. The oven door of claim 12 wherein said air-directing plenum includes air-directing vanes disposed adjacent to said second group of openings.

14. An oven comprising:

a box-like structure forming a heating chamber, said box-like structure having a top wall, a rear wall, a bottom wall, opposing side walls and a front wall having an opening formed therein for accessing the heating chamber of said oven;

at least one heating unit operatively carried within said heating chamber for heating oven contents;

a source for providing heating energy to said heating unit; and a door for closing the opening in the front wall of said oven, said door being adapted to be opened, said door including:

a front panel;

a rear panel that is substantially parallel to and spaced from said front panel, thereby forming a door interior, said rear panel including a plurality of openings formed therein;

an interior partition defining a chamber within said door interior in the outward side of said interior partition and a plenum within said door interior on the inward side of side interior partition; and a blower system arranged within said door interior adapted to circulate air through said door interior, said plurality of openings, and said heating chamber of said oven, said blower system including a motor located within said chamber, a first fan located in said plenum of said door interior in a central lower portion of said door for circulating air in said heating chamber of said oven, and a second fan located in said chamber for circulating air within said chamber to cool said motor during operation, said first and second fans being supported on a single drive shaft coupled to said motor, said drive shaft extending through an opening formed in said interior partition into said plenum, said plenum being in air flow communication with said heating chamber of said oven through inlet means and outlet means, said first fan being disposed within said plenum adjacent to said inlet means and being adapted to draw air from a central region of said heating chamber into said plenum through said inlet means and to expel air out of said plenum into said heating chamber generally adjacent to the side walls of said heating chamber through said outlet means, said inlet means comprising a first group of air passages arranged axially with respect to said first fan and said outlet means comprising a second and third group of openings located symmetrically apart from said first group of openings on opposite sides thereof.

* * * * *